US010378086B2

(12) United States Patent
Asada et al.

(10) Patent No.: US 10,378,086 B2
(45) Date of Patent: Aug. 13, 2019

(54) SLIDING CONTACT MATERIAL AND METHOD FOR MANUFACTURING SAME

(71) Applicant: TANAKA KIKINZOKU KOGYO K.K., Chiyoda-ku, Tokyo (JP)

(72) Inventors: Takao Asada, Oshu (JP); Takumi Niitsuma, Oshu (JP); Masahiro Takahashi, Tomioka (JP); Terumasa Tsuruta, Tomioka (JP)

(73) Assignee: TANAKA KIKINZOKU KOGYO K.K., Tokyo (JP)

( * ) Notice: Subject to any disclaimer, the term of this patent is extended or adjusted under 35 U.S.C. 154(b) by 281 days.

(21) Appl. No.: 15/527,422

(22) PCT Filed: Dec. 17, 2015

(86) PCT No.: PCT/JP2015/085356
§ 371 (c)(1),
(2) Date: May 17, 2017

(87) PCT Pub. No.: WO2016/104323
PCT Pub. Date: Jun. 30, 2016

(65) Prior Publication Data

US 2018/0223394 A1 Aug. 9, 2018

(30) Foreign Application Priority Data

Dec. 26, 2014 (JP) ..... 2014-264256

(51) Int. Cl.
*C22C 5/08* (2006.01)
*C22C 5/06* (2006.01)
(Continued)

(52) U.S. Cl.
CPC ..... *C22C 5/08* (2013.01); *C22C 5/06* (2013.01); *C22F 1/14* (2013.01); *H01B 1/026* (2013.01);
(Continued)

(58) Field of Classification Search
CPC .... C22C 5/06; C22C 5/08; C22F 1/14; H01B 1/026; H01R 13/03; H01R 39/20; H01R 43/12
See application file for complete search history.

(56) References Cited

FOREIGN PATENT DOCUMENTS

| | | |
|---|---|---|
| CN | 101246758 | 8/2008 |
| CN | 102304640 | 1/2012 |

(Continued)

OTHER PUBLICATIONS

International Search Report for PCT/JP2015/085356, dated Mar. 15, 2016.

*Primary Examiner* — Jenny R Wu
(74) *Attorney, Agent, or Firm* — Orrick, Herrington & Sutcliffe LLP; Joseph A. Calvaruso

(57) ABSTRACT

The present invention is a sliding contact material having a composition of Cu of 6.0% by mass or more and 9.0% by mass or less, Ni of 0.1% by mass or more and 2.0% by mass or less, an additive element M of 0.1% by mass or more and 0.8% by mass or less, and the balance being Ag. The additive element M is at least one element selected from the group consisting of Sm, La and Zr. The present sliding contact material has a material structure in which dispersion particles containing an intermetallic compound containing at least both Ni and an additive element M are dispersed in an Ag alloy matrix. It is required that the ratio of a Ni content (% by mass) and a content of an additive element M (% by mass) ($K_{Ni}/K_M$) in the dispersion particles falls within a predetermined range. The present invention is an Ag alloy-based sliding contact material more excellent also in abrasion resistance than conventional ones, and a material adaptable to higher rotation numbers of micromotors.

20 Claims, 5 Drawing Sheets

Result of EDS analysis

| Spectrum | % by mass |
|---|---|
| Ag | 1.43 |
| Cu | 16.13 |
| Zn | 2.31 |
| Ni | 54.5 |
| Sm | 25.63 |
| Total | 100 |

(51) Int. Cl.

| | |
|---|---|
| ***C22F 1/14*** | (2006.01) |
| ***H01R 39/20*** | (2006.01) |
| ***H01R 43/12*** | (2006.01) |
| ***H01B 1/02*** | (2006.01) |
| ***H01R 13/03*** | (2006.01) |

(52) U.S. Cl.
CPC ..... *H01R 13/03* (2013.01); *H01R 39/20* (2013.01); *H01R 43/12* (2013.01)

(56) References Cited

FOREIGN PATENT DOCUMENTS

| | | |
|---|---|---|
| JP | 50-104720 | 8/1975 |
| JP | 58-107452 | 6/1983 |
| JP | 6-172894 | 6/1994 |
| JP | 7-228931 | 8/1995 |

Example 11

Example 13

Example 11

Result of EDS analysis

| Spectrum | % by mass |
|---|---|
| Ag | 1.43 |
| Cu | 16.13 |
| Zn | 2.31 |
| Ni | 54.5 |
| Sm | 25.63 |
| Total | 100 |

Comparative example 1

Comparative example 2

Comparative example 2

Result of EDS analysis

| Spectrum | % by mass |
|---|---|
| Ag | 38.95 |
| Cu | 36.13 |
| Sm | 24.92 |
| Total | 100 |

SLIDING CONTACT MATERIAL AND METHOD FOR MANUFACTURING SAME

TECHNICAL FIELD

The present invention relates to a sliding contact material composed of an Ag alloy. In particular, it relates to a sliding contact material that can be used suitably for a commutator for a motor, and the like, for which a load may be increased due to a higher rotation number, etc.

BACKGROUND ART

A motor is a device that is used in many applications, such as various home electric appliances and automobiles, and, in these years, there have been increasing demands for motors having a higher level regarding the reduction in size and increase in output. Due to the tendency, a motor rotation number increases, and a motor, which can adapt to the increase and exert long operation life, is requested.

Examples of stopping of a motor caused by the end of life time include stopping due to mechanical abrasion generated between a commutator and a brush that are constituent parts of the motor. In the phenomenon, a material of a commutator moves and adheres to a brush as a result of abrasion caused by sliding in a motor drive process, which moves and adheres again to the commutator to generate coarse abrasion particles in the process. Then, the abrasion particles accumulate in a slit of the commutator, and the commutator short-circuits to stop the motor. When the mechanism is considered, an effort for making operation life of a motor longer includes improvement of abrasion resistance properties of sliding contact materials constituting these parts.

As a sliding contact material applied to a motor, etc., an Ag-based alloy is well known, in consideration of electroconductivity in addition to abrasion resistance. For example, there are known an Ag—Cu alloy in which Ag is alloyed with Cu, an Ag—Cu—Zn alloy and an Ag—Cu—Zn—Mg alloy, etc. in which Zn, and additionally Mg is alloyed.

PRIOR ART DOCUMENTS

Patent Literature

PTL 1: Japanese Patent-laid Open No. H06-172894

SUMMARY OF INVENTION

Technical Problem

Sliding contact materials disclosed until now exert a certain effect, but, in order to develop a motor that can also endure a load caused by the above-described increase in the motor rotation number, a material more excellent in abrasion resistance is demanded. Accordingly, the present invention aims at providing a material more excellent also in abrasion resistance than conventional technology, regarding a sliding contact material based on an Ag alloy.

Solution to Problem

The present invention that solves the above problem is a sliding contact material composed of Cu of 6.0% by mass or more and 9.0% by mass or less, Ni of 0.1% by mass or more and 2.0% by mass or less, an additive element M of 0.1% by mass or more and 0.8% by mass or less, the balance being Ag and inevitable impurities, wherein the additive element M is at least one element selected from the group consisting of Sm, La and Zr, the sliding contact material has, as a material structure of M, a material structure in which dispersion particles containing an intermetallic compound containing at least both Ni and the additive element M are dispersed in an Ag alloy matrix, and a ratio ($K_{Ni}/K_M$) of a Ni content (% by mass) and a content of the additive element M (% by mass) in the dispersion particle falls within a range below, when the additive element M is Sm, La: 1.50 or more and 2.50 or less, when the additive element M is Zr: 1.80 or more and 2.80 or less.

The sliding contact material according to the present invention is a material that uses an Ag—Cu alloy as an alloy to be a base, to which Ni, and a rare earth element (Sm, La) or Zr are added. Further, the Ag alloy works as a matrix, in which dispersion particles containing a predetermined intermetallic compound are dispersed. That is, in the present invention, an Ag alloy is reinforced by a dispersion reinforcement mechanism of an intermetallic compound, so as to be provided with abrasion resistance effective as a sliding contact material.

What is important here is that a dispersion particle exerting a reinforcement action is not a phase that simply has a different composition relative to an Ag alloy to be a matrix. Ni and a rare earth element such as Sm can form a dispersion particle alone without being solid-dissolved to Ag, but, in the instance, improvement of abrasion resistance cannot be expected. A dispersion particle effective in the present invention is required to be one containing an intermetallic compound containing both Ni and an additive element M, and to be provided with a predetermined ratio about contents of Ni and the additive element M.

Moreover, although each of Sm, La and Zr forms an intermetallic compound with Ni, the constitution of the compound is of not one type but plural kinds of intermetallic compounds may be formed. As an example, an instance that both Ni and Sm are added will be described. FIG. 1 shows a state diagram of a Sm—Ni system, and, as is understood from the diagram, a plurality of intermetallic compounds may be formed according to a constituent ratio of Sm and Ni in the system. The present inventors confirm that, when Sm and Ni are added to an Ag alloy, an intermetallic compound capable of reinforcing effectively the alloy is $SmNi_5$. Intermetallic compounds other than $SmNi_5$ do not contribute to the reinforcement of materials.

The point that a specific intermetallic compound having an reinforcement action must be selected in this way is the same in the case of La and Zr. Concretely, $LaNi_5$ is useful in the case of La, and $Zr_2Ni_7$ is useful in the case of Zr. FIG. 2 shows state diagrams of a La—Ni system and a Ni—Zr system, and intermetallic compounds in a specific region are required for the systems. The sliding contact materials according to the present invention are reinforced by dispersion particles containing mainly these useful intermetallic compounds. Hereinafter, the constitution of the present invention will be described in more detail.

As described above, the sliding contact material according to the present invention is composed of Cu of 6.0% by mass or more and 9.0% by mass or less, Ni of 0.1% by mass or more and 2.0% by mass or less, an additive element M of 0.1% by mass or more and 0.8% by mass or less, the balance being Ag and inevitable impurities, as the overall composition.

Here, respective constituent elements will be described. Cu works mainly as a constituent component of an Ag alloy that becomes a matrix of the sliding contact material according to the present invention. By setting an additive amount of Cu in a proper range, the matrix has a proper strength. In both cases where the concentration of Cu is less than 6.0% by mass and it exceeds 9.0% by mass, the abrasion resistance of the sliding contact material deteriarates and an abrasion volume increases.

Ni is a constituent element of an intermetallic compound having a reinforcing action, as has been described above. The reason why the concentration of Ni is determined to be 0.1% by mass or more and 2.0% by mass or less is that, an effective intermetallic compound is hardly generated outside the range. In particular, when it exceeds 2.0% by mass, segregation of Ni is also generated to deteriorate processability.

An additive element M (Sm, La, Zr), should be in the range of 0.1% by mass or more to 0.8% by mass or less. The reason is to generate an intermetallic compound of an effective composition. When plural kinds of additive elements is to be added from among Sm, La, and Zr, the total additive amount is set to be 0.1% by mass or more and 0.8% by mass or less. The concentration of the additive element M is more preferably set to be 0.4% by mass or more and 0.8% by mass or less. Although details will be described later, the concentration of an additive element M and the Ni concentration are preferably adjusted in consideration of the ratio of the both elements.

In an Ag alloy having the above-described overall composition, the Ag alloy to become a matrix is an Ag—Cu alloy. Further, a matrix when Zn and Mg are added, which will be described later, is constituted from an Ag—Cu—Zn alloy and Ag—Cu—Zn—Mg alloy. That is, Ni and additive element M are scarcely contained in a matrix. Because, these additive elements do not have a solid-solution range relative to Ag, and Ni concentration in a matrix is 0.1% by mass or less.

Further, the dispersion particle prescribed as the feature in the present invention has an intermetallic compound of Ni and an additive element M (Sm, La, Zr) ($SmNi_5$, $LaNi_5$, $Zr_2Ni_7$) as a main component, but it is not necessarily constituted by these alone. For example, in an instance of a sliding contact material to which Sm is added as an additive element M, Cu may be contained in a dispersion particle in addition to Ni and Sm. In the instance, it is presumed that Cu is solid-dissolved to $SmNi_5$ to form a dispersion particle, or $SmNi_5$ is mixed with an alloy phase containing Cu (such as CuNi), which is unified to form a dispersion particle. In this way, the dispersion particle in the present invention may contain an element in addition to Ni and the additive element M such as Sm.

Meanwhile, even when a dispersion particle contains an element in addition to Ni and an additive element M, a dispersion particle that is deemed to be effective in the present invention has a suitable intermetallic compound ($SmNi_5$, $LaNi_5$, $Zr_2Ni_7$) as a main component, and, therefore, the value of ratio ($K_{Ni}/K_M$) of a Ni content (% by mass) and a content of additive element M (% by mass) in the dispersion particle falls in a certain range. The ratio ($K_{Ni}/K_M$) of contents is determined to be, when the additive element M is Sm or La, 1.50 or more and 2.50 or less, and to be, when the additive element M is Zr, 1.80 or more and 2.80 or less. According to the investigation of the present inventors, it is considered that a dispersion particle having a value of $K_{Ni}/K_M$ outside the above-described range is a dispersion particle not constituted from an intermetallic compound of Ni and an additive element M, or that, even when it is a dispersion particle containing an intermetallic compound of Ni and an additive element M, it corresponds to a dispersion particle composed of an intermetallic compound other than intermetallic compounds having a reinforcing action ($SmNi_5$, $LaNi_5$, $Zr_2Ni_7$). Such dispersion particles do not act on material reinforcement.

From among Sm, La, and Zr that are additive elements M, any two or three kinds of metal elements may be added. Further, the total value of contents of additive elements M in the dispersion particle is applied to the value of $K_M$ in a dispersion particle when a plurality kinds of additive elements M is added.

Meanwhile, as to the constitution of a dispersion particle when a plurality kinds of additive elements is added, a binary intermetallic compound constituted from one kind of metal element and Ni is frequently generated. For example, when three kinds of elements of Sm, La, and Zr are added, each of three kinds of intermetallic compounds is generated, that is, an intermetallic compound of Ni and Sm, an intermetallic compound of Ni and La, and an intermetallic compound of Ni and Zr, to constitute separate dispersion particles with high probability. In this instance, it is sufficient that each of dispersion particles has a value of $K_{Ni}/K_M$ within a range set for contained additive elements M. However, there may be generated an intermetallic compound composed of all of added plural kinds of elements. In this instance, it is sufficient that the total of contents of a plurality of kinds of additive elements in the dispersion particle is defined as $K_M$, and that the value of $K_{Ni}/K_M$ satisfies all the range set for additive elements M in the dispersion particle. For example, when two kinds of elements of Sm and Zr are added and an intermetallic compound of Sm and Zr with Ni is generated, the total value of the content of Sm and the content of Zr in a dispersion particle is determined as $K_M$. Then, it is required that the value of $K_{Ni}/K_M$ satisfies both the condition for Sm (1.50 or more and 2.50 or less) and the condition for Zr (1.80 or more and 2.80 or less), that is, the value is 1.80 or more and 2.50 or less.

Furthermore, in the present invention, it is preferable to adjust the ratio of the Ni concentration ($S_{Ni}$: % by mass) and the concentration of an additive element M ($S_M$: % by mass) in the overall composition, in order to upgrade the composition of the dispersion particle and the distribution state thereof. The suitable range of the concentration ratio ($S_{Ni}/S_M$) differs according to the kind of the additive element M. Concretely, in instances of materials containing Sm as the additive element M, a preferable range is 0.80 or more and 5.0 or less. Further, in instances of materials containing La as the additive element M, a preferable range is 1.50 or more and 5.0 or less, and in instances of materials containing Zr as the additive element M, a preferable range is 1.40 or more and 6.7 or less.

Meanwhile, when two or three kinds of metal elements among Sm, La, and Zr are to be added, the total value of concentrations of respective additive elements is applied to the concentration of an additive element M ($S_M$). Further, preferably the concentration ratio ($S_{Ni}/S_M$) satisfies all of the suitable ranges set to respective additive elements. For example, in an instance of a material to which two elements of Sm and Zr have been added, it is preferable that the total of the Sm concentration and Zr concentration is set to be the concentration of an additive element M ($S_M$) and the concentration ratio ($S_{Ni}/S_M$) satisfies both the suitable condition for Sm (0.80 or more and 5.0 or less) and the suitable condition for Zr (1.40 or more and 6.7 or less), that is, 1.4 or more and 5.0 or less.

The sliding contact material according to the present invention is based on an AgCu alloy, but another additive element may be added to the material. In particular, addition of Zn in 0.1% by mass or more and 2.0% by mass or less contributes to the reinforcement of an Ag alloy that becomes a matrix, to lead to the material reinforcement of the overall sliding contact material. Further, to the same effect, a sliding contact material containing Mg of 0.05% by mass or more and 0.3% by mass or less also has preferable properties such as sliding properties.

The sliding contact material according to the present invention has such an inevitable constitution that the dispersion particle containing the predetermined intermetallic compound as described above is dispersed, but does not deny existence of other phases (precipitates). Here, other phases that may be generated include an alloy phase of Cu and Ni (CuNi), an alloy phase of Cu and Ni and Zn (CuNiZn) that may be generated when Zn is added, etc. Although these precipitation phases do not largely contribute to material reinforcement, the existence thereof is allowed because they do not act as a hindrance factor.

Next, the method for manufacturing a sliding contact material according to the present invention will be described. The sliding contact material according to the present invention may basically be manufactured by a melt casting method. That is, it may be manufactured by generating molten metal of an Ag alloy composed of Cu of 6.0% by mass or more and 9.0% by mass or less, Ni of 0.1% by mass or more and 2.0% by mass or less, an additive element M of 0.1% by mass or more and 0.8% by mass or less, the balance being Ag and inevitable impurities, and consequently, by cooling and solidifying the molten metal.

However, in the present invention, it is necessary to form an intermetallic compound having a reinforcing action and to disperse a dispersion particle having a ratio ($K_{Ni}/K_M$) of a Ni content and a content of an additive element M. In each instance, the above-described effective intermetallic compound has high melting point and high solidus temperature. Therefore, in the present invention, temperature management of molten metal is important, and it is necessary to set temperature of molten metal before cooling and solidification to 1300° C. or higher. It is sufficient when molten metal temperature reaches the temperature before cooling and it is unnecessary to hold the temperature for a long time, and it is preferable to hold the molten metal temperature for around 5 to 10 minutes and then cool it. The upper limit of the heating temperature is preferably set to be 1400° C. or lower, from practical viewpoints, such as energy cost and apparatus maintenance.

In addition, one more important point in the method for manufacturing a sliding contact material according to the present invention is a cooling rate in solidification. The intermetallic compound that is inevitable in the present invention tends to have specific gravity lower than that of a matrix (Ag alloy), and, therefore, if a cooling rate is low, generated intermetallic compounds float to be an obstacle in uniform dispersion. Further, when a cooling rate is too slow, there may be generated composition fluctuation of an intermetallic compound having a suitable composition to change into an intermetallic compound having an unpreferable composition. From the situation, in the present invention, a cooling rate in solidification is set to be 100° C./min or larger. The upper limit of the cooling rate is preferably set to be 3000° C./min or less.

Meanwhile, when Ag alloy molten metal is to be manufactured, usually, highly pure raw materials of respective metal components (such as Ag, Cu) are used, and they are mixed and molten. At this time, the sliding contact material of the present invention may be recycled and used. The intermetallic compound in the sliding contact material of the present invention is heated to a liquidus-line temperature or higher to be molten reversibly and is cooled to be regenerated with the same composition. For example, it is possible to utilize end materials in previous manufacturing and used materials (not contaminated ones).

Advantageous Effects of Invention

As described above, the sliding contact material according to the present invention has high abrasion resistance by applying an intermetallic compound of Ni and a specific element whose usefulness has not been confirmed until now. The present invention is useful as a constituent material of a motor in which smaller size and higher rotation number progress. In particular, it is useful as a sliding contact material for use in a commutator of a micromotor. Meanwhile, the sliding contact material according to the present invention can be used as a solid material, or can be used as a form of a cladding material. For example, a cladding material is mentioned, in which the sliding contact material according to the present invention is combined with either Cu or a Cu alloy. At this time, the sliding contact material according to the present invention is joined to a part or the whole surface of Cu or a Cu alloy as a sliding surface.

DESCRIPTION OF EMBODIMENTS

Figure 1:
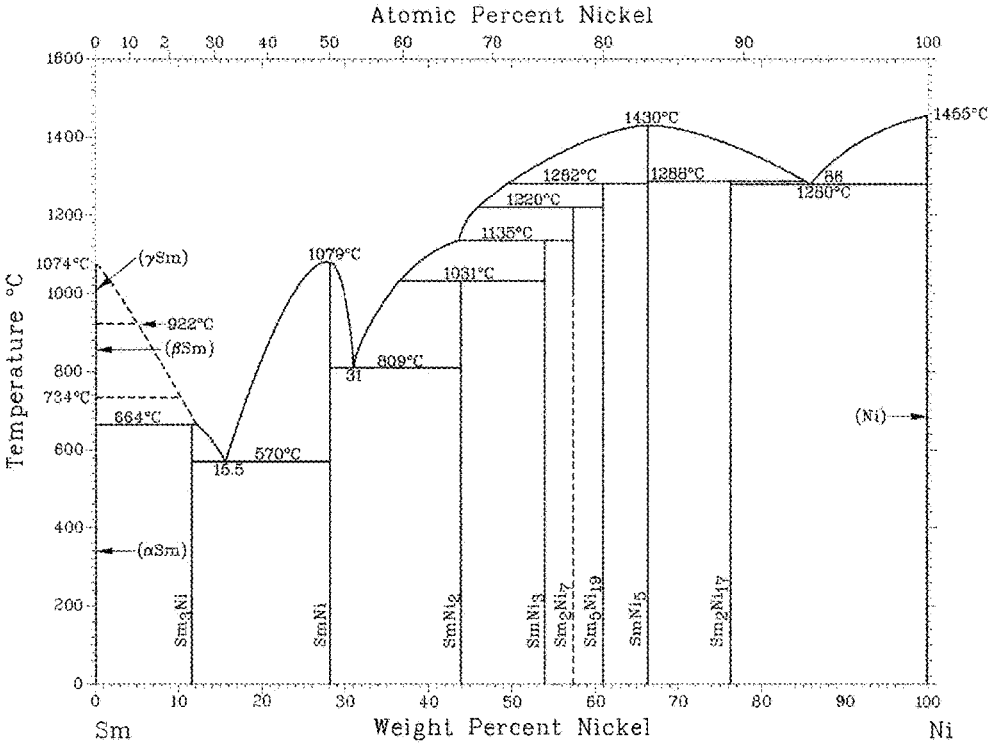
FIG. 1 shows a state diagram of a Sm—Ni system for describing an intermetallic compound generated in the present invention.
Figure 2:
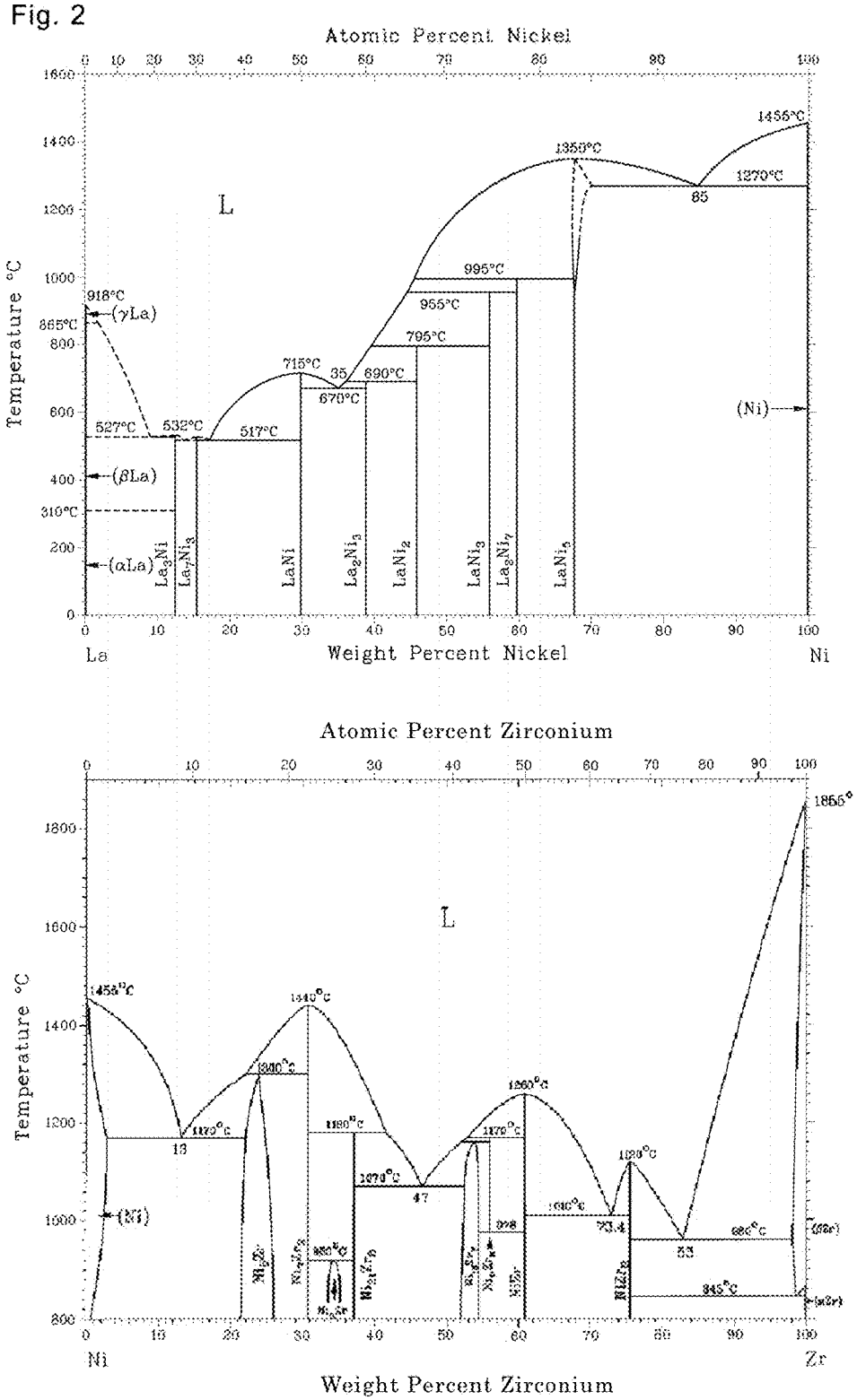
FIG. 2 shows a state diagram of a La—Ni system and a state diagram of a Ni—Zr system for describing an intermetallic compound generated in the present invention.

Hereinafter, an embodiment of the present invention will be described. In the present embodiment, there was manufactured a sliding contact material in which Ni and an additive element, such as Sm, were added to an Ag—Cu alloy etc., and abrasion resistance was evaluated. A test material was manufactured by mixing highly pure raw materials so as to give a predetermined composition, subjecting the mixture to high frequency melting to give molten metal, heating the molten metal with the measurement of temperature so as to become 1300° C. or higher, and thereafter quenching the same to give an alloy ingot. The cooling rate at this time is 100° C./min. Then, the alloy ingot was subjected to rolling processing and annealing at 600° C., and thereafter was subjected again to rolling processing and to cutting processing to give a test piece (length: 45 mm, width: 4 mm, thickness: 1 mm).

In the present embodiment, as Examples 1 to 29, sliding contact materials of various compositions were manufactured through the above-described manufacturing process. Further, as Comparative Examples, there were manufactured alloys to which only one of Ni and Sm had been added (Comparative Examples 1, 2), and an alloy having an excessive Ni concentration (Comparative Example 3). In addition, there was also manufactured a sample to which Eu, which is a rare earth element other than Sm and La, had been added as an additive metal (Comparative Example 4).

Further, in the present embodiment, influence due to manufacturing conditions of an alloy is also examined. Here, the molten metal temperature was set to lower (1100° C.) than the temperature (1300° C.) in respective Examples, from which the molten metal was chilled and alloys were manufactured (Comparative Examples 5, 7 and 8). Moreover, while the molten metal was kept at 1300° C. or higher, the molten metal was gradually cooled at less than 100° C./min through furnace cooling to manufacture an alloy (Comparative Example 6). Meanwhile, the alloys in Comparative Examples 5 and 6 have the same composition as in Example 13. Moreover, the alloy in Comparative Example 7 has the same composition as in Example 2, and the alloy in Comparative Example 8 has the same composition as in Example 7.

Respective manufactured samples were first subjected to structure observation by SEM and presence or absence of precipitation of dispersion particles was checked. Then, 20 dispersion particles were selected randomly, qualitative analysis of the dispersion particles was performed by EDX to measure a Ni content and an M content in the dispersion particles, and the ratio thereof ($K_{Ni}/K_M$) was calculated. Regarding Examples 1 to 29, it was confirmed that $K_{Ni}/K_M$ fell within the proper range in all the measured dispersion particles, and then an average value thereof was calculated. Regarding Comparative Examples, presence or absence of a dispersion particle containing both Ni and an additive element M was first examined for observed dispersion particles, and, when a dispersion particle containing Ni and an additive element M was not observed, the instance was decided that "No" dispersion particle existed. Moreover, when dispersion particles containing Ni and an additive element M were observed, after it was confirmed that all of $K_{Ni}/K_M$ fell outside the proper range, an average value thereof was calculated. As the result, in Comparative Examples 3, 5 to 8, although dispersion particles containing Ni and an additive element M were observed, dispersion particles having values of $K_{Ni}/K_M$ within the proper range could not be found.

Figure 3:
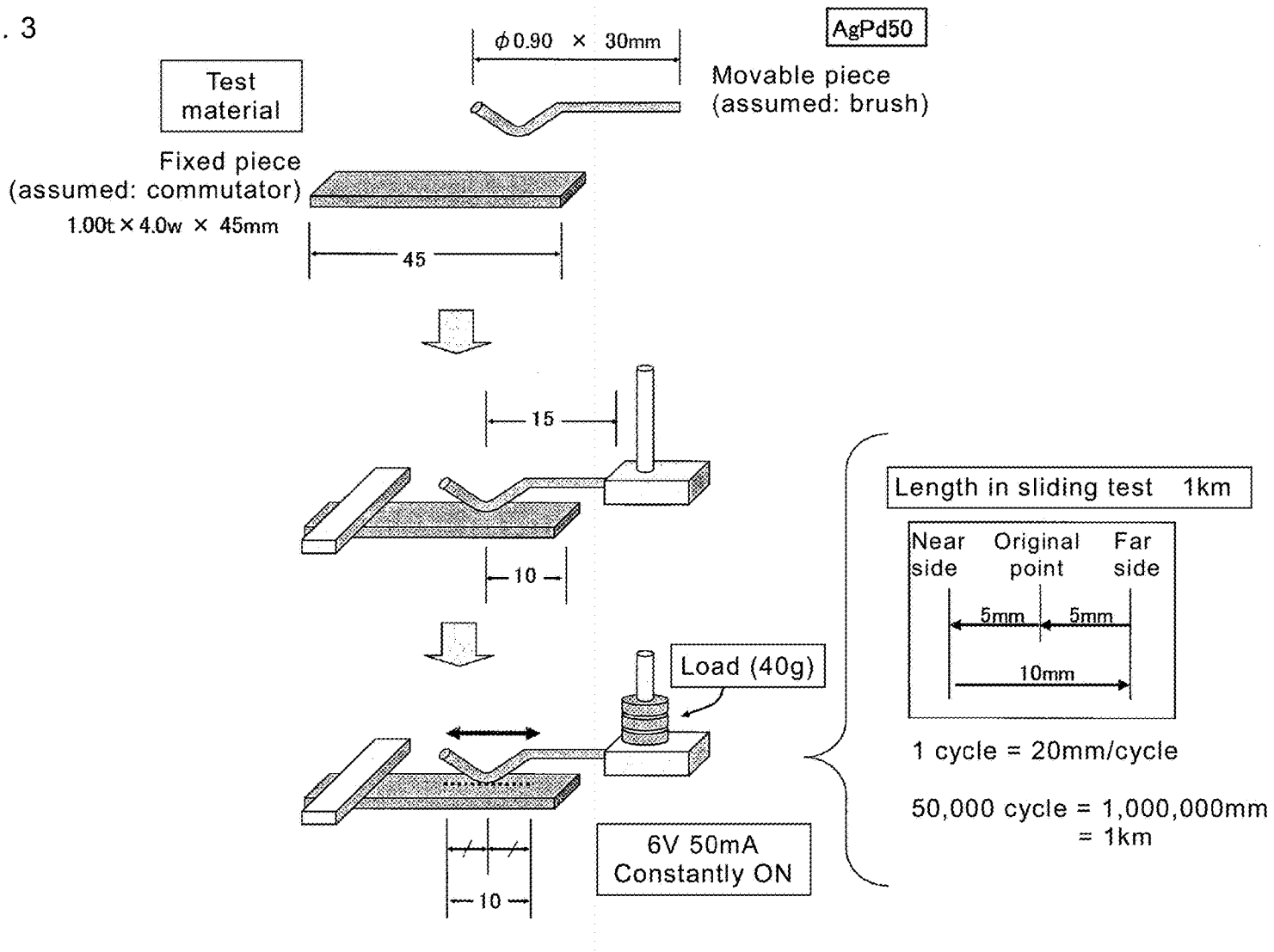
FIG. 3 shows a view for depicting a test method of a sliding test performed in the present embodiment.

Further, for respective test pieces, a sliding test for evaluating abrasion resistance was performed. FIG. 3 roughly describes a method of the sliding test. In the test, each of test pieces according to respective Examples was used as a fixed contact, on which a wire material of AgPd50 processed as a movable contact assuming a brush was abutted and slid. On this occasion, the movable contact was applied with a load of 40 g while being constantly energized with 6 V and 50 mA, and, with one cycle defined such that when the movable contact moved total 20 mm after reciprocating back and forth 5 mm from a starting point (10 mm), was slid 50000 cycles (total sliding length was 1 km). After that, abrasion depth of a slid part was measured. Results are shown in Table 1. There are also shown in the evaluation results of measurement values of sliding contact materials composed of an Ag—Cu alloy, Ag—Cu—Zn alloy being a conventional technique.

TABLE 1

| | Composition (% by mass) | | | | | | | | | | Dispersion particle | Abrasion volume |
|---|---|---|---|---|---|---|---|---|---|---|---|---|
| | | | | | | Additive element M | | | | | | |
| | Ag | Cu | Zn | Mg | Ni | Sm | La | Zr | Eu | $S_{Ni}/S_M$ | $K_{Ni}/K_M$ | μm² |
| Example 1 | Balance | 6.00 | — | — | 0.50 | 0.50 | — | — | — | 1.00 | 2.18 | 784 |
| Example 2 | | | | | 0.30 | — | 0.10 | | | 3.00 | 2.32 | 795 |
| Example 3 | | | | | 0.30 | | — | 0.20 | | 1.50 | 2.25 | 760 |
| Example 4 | | | | | 1.00 | | 0.40 | — | | 2.50 | 2.09 | 755 |
| Example 5 | | | | | 1.00 | 0.80 | — | | | 1.25 | 2.10 | 648 |
| Example 6 | | | | | 2.00 | 0.80 | | | | 2.50 | 2.21 | 720 |
| Example 7 | | | 0.50 | | 0.30 | 0.20 | | | | 1.50 | 1.99 | 722 |
| Example 8 | | 8.00 | — | — | 0.30 | — | 0.40 | — | | 0.75 | 2.28 | 662 |
| Example 9 | | | | | 1.00 | 0.40 | — | | | 2.50 | 2.14 | 505 |
| Example 10 | | | | | | — | 0.80 | | | 1.25 | 2.17 | 430 |
| Example 11 | | | 1.00 | | 0.93 | 0.50 | — | | | 1.80 | 2.13 | 275 |
| Example 12 | | | | | 0.20 | 0.20 | | | | 1.00 | 2.09 | 792 |
| Example 13 | | | | | 0.50 | 0.50 | | | | 1.00 | 2.07 | 746 |
| Example 14 | | | | | 0.80 | 0.80 | | | | 1.00 | 1.87 | 757 |
| Example 15 | | | | | 0.50 | 0.40 | | | | 1.25 | 2.20 | 353 |
| Example 16 | | | | | | 0.10 | | | | 5.00 | 1.63 | 508 |
| Example 17 | | | | | | — | 0.30 | | | 1.67 | 2.24 | 400 |
| Example 18 | | | | | | | 0.10 | | | 5.00 | 2.15 | 547 |
| Example 19 | | | | | | | — | 0.30 | | 1.67 | 2.60 | 642 |
| Example 20 | | | | 0.05 | 0.50 | 0.50 | | — | | 1.00 | 1.50 | 665 |
| Example 21 | | | | — | 0.50 | 0.70 | | | | 0.71 | 2.13 | 823 |
| Example 22 | | | | | 1.80 | 0.30 | | | | 6.00 | 2.35 | 883 |
| Example 23 | | | | | 0.15 | | 0.40 | | | 0.38 | 1.55 | 895 |
| Example 24 | | | | | 0.80 | | — | 0.60 | | 1.33 | 1.86 | 899 |
| Example 25 | | | 0.10 | | 0.30 | 0.20 | | — | | 1.50 | 1.96 | 786 |
| Example 26 | | 8.80 | — | — | 1.00 | 0.80 | — | — | | 1.25 | 2.15 | 683 |
| Example 27 | | | | | 2.00 | — | | 0.80 | | 2.50 | 2.63 | 452 |
| Example 28 | | | 2.00 | | 0.30 | 0.20 | | — | | 1.50 | 1.95 | 623 |
| Example 29 | | | — | 0.30 | 0.50 | 0.20 | | | | 2.50 | 2.12 | 792 |
| Comparative example 1 | Balance | 6.00 | 1.00 | — | 0.50 | — | — | — | — | — | None | 1930 |
| Comparative example 2 | | 8.00 | 1.00 | | — | 0.30 | — | — | | — | None | 1112 |
| Comparative example 3 | | | | | 2.80 | 0.50 | | | | 5.60 | 4.18 | 993 |
| Comparative example 4 | | | | | 0.50 | — | | | 0.30 | 1.67 | None | 1540 |

TABLE 1-continued

| | Composition (% by mass) | | | | | | | | | | Dispersion particle | Abrasion volume |
|---|---|---|---|---|---|---|---|---|---|---|---|---|
| | | | | | | Additive element M | | | | | | |
| | Ag | Cu | Zn | Mg | Ni | Sm | La | Zr | Eu | $S_{Ni}/S_M$ | $K_{Ni}/K_M$ | $\mu m^2$ |
| Comparative example 5 | | | | | 0.50 | 0.50 | | | — | 1.00 | 0.83 | 983 |
| Comparative example 6 | | | | | | | | | | | 1.20 | 1010 |
| Comparative example 7 | | 6.00 | — | | 0.30 | — | 0.10 | — | | 3.00 | 0.96 | 1206 |
| Comparative example 8 | | | 0.50 | | 0.30 | 0.20 | — | | | 1.50 | 1.12 | 1125 |
| Conventional example 1 | Balance | 8.00 | — | — | — | — | — | — | — | — | None | 4233 |
| Conventional example 2 | | | 1.00 | — | — | — | — | — | | — | None | 3326 |

From Table 1, it is confirmed that alloys to which Ni and additive element M (Sm, La, Zr) were concurrently added (Examples 1 to 29) have abrasion resistance dramatically improved as compared with conventional examples 1 and 2. Regarding Ni and the additive element M, addition of both is indispensable, and addition of only either one does not exert the effect. This can be grasped from comparison relative to Comparative Examples 1 and 2. In Comparative Examples 1 and 2, no intermetallic compound was generated, and Ni and Sm that could not be solid-dissolved to an Ag alloy being a matrix were dispersed separately.

Figure 4:
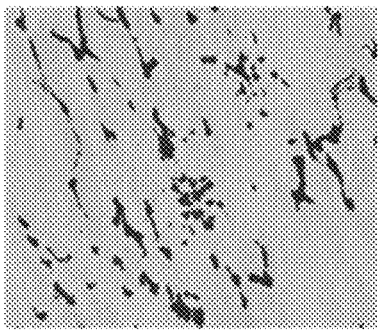
FIG. 4 shows metal structure photographs in Examples 11 and 13, and EDS analysis result in Example 11.
Figure 4:
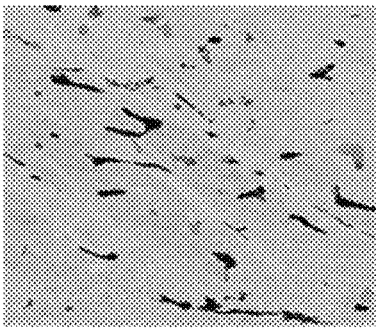
Figure 4:
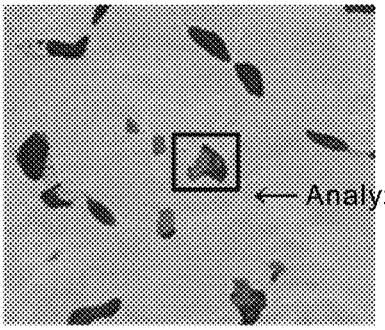
Figure 5:
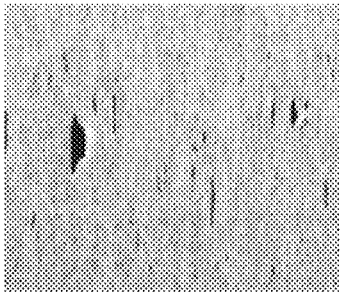
FIG. 5 shows metal structure photographs in Comparative Examples 1 and 2, and EDS analysis result in Comparative Example 2.
Figure 5:
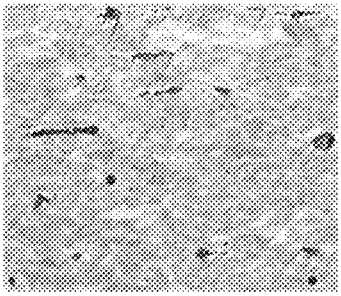
Figure 5:
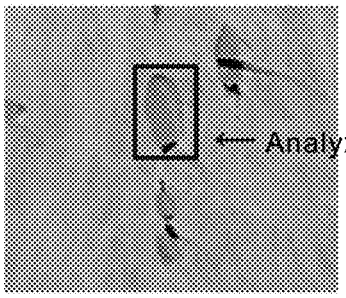

FIG. 4 shows metal structure photographs in Examples 11 and 13. In either sample, there are seen spherical dispersion particles caused by formation of an intermetallic compound of Ni and Sm. The alloy in Example 11 was an alloy showing the least abrasion volume and was excellent in abrasion resistance. In FIG. 4, an EDS analysis result of the dispersion particle in Example 11 is also shown as an example, from which it is known that the particle contains Ni and Sm in a proper quantity. On the other hand, FIG. 5 shows metal structure photographs in Comparative Examples 1 and 2. In Comparative Example 1, Ni alone is added, and a Ni phase of a long needle shape is seen. In Comparative Example 2, Sm alone was added, and no dispersion particle differing from Examples 11 and 13 was seen. In Comparative Example 2, an observed precipitation phase was subjected to EDS analysis, and naturally, the precipitation phase did not contain Ni.

When Comparative Examples 3 to 8 are referred to in point of the constitution of the dispersion particle, it can be understood that the control of the ratio of a Ni content and a content of an additive element M ($K_{Ni}/K_M$) is necessary. That is, in each of Examples, there were not observed dispersion particles having a $K_{Ni}/K_M$ value falling outside the regulated range corresponding to each additive element. In contrast, in each of Comparative Examples, there were not observed an alloy in which a dispersion particle (intermetallic compound) did not exist and a dispersion particle having a $K_{Ni}/K_M$ value falling within a suitable range, although dispersion particles had been precipitated. For example, when Ni is exessive as is the case for Comparative Example 3, a dispersion particle with much Ni is generated. The Comparative Example 3 shows a slightly improved abrasion resistance but cannot be said to be good, as compared with Comparative Examples 1 and 2 and conventional examples 1 and 2.

Further, when results of respective Examples are examined in detail, it is possible to say that the selection of Sm, La, and Zr as an additive element is effective. This can be understood from the fact that, although Eu being a rare earth element was added in Comparative Example 4, an intermetallic compound was not generated and no improvement of abrasion resistance was observed. Moreover, from results in Examples 21 to 24, it is possible to say that the control of the ratio of Ni concentration and the concentration of an additive element M ($S_{Ni}/S_M$) in the overall composition of an alloy is preferable in order to cause the alloy to exert more suitable abrasion resistance. Because, in these Examples, an abrasion volume exceeds 800 $\mu m^2$ and the abrasion resistance is considered to be slightly inferior to those in other Examples.

Meanwhile, the present invention is based on alloys in which Ni and Sm and the like are added in an Ag—Cu alloy (Examples 1 to 6, Examples 8 to 10, Examples 26 and 27). Further, by adding Zn to the alloy system constituting the base, it is furthermore reinforced (Examples 7, 11 to 25, 28). Moreover, Mg may be added (Example 29).

In addition, from the results in Comparative Examples 5 to 8, it is known that setting of manufacturing conditions is important in order to obtain a suitable alloy. That is, Comparative Examples 5 and 6 are the same as Example 13 in terms of the composition, but the alloy was manufactured under such a manufacturing condition as low molten metal temperature or a slow cooling rate. While Comparative Examples 7 and 8 were also common to Examples 2 and 7 respectively in terms of the compositions, and the alloys were cast at molten metal temperature set to be low. In these Comparative Examples, no effective intermetallic compound is generated, the composition of dispersion particles falls outside the range, and abrasion resistance is also inferior. Accordingly, it is confirmed that the evaluation of the material according to the present invention based only on the composition (overall composition) is not preferable, but that a material structure associated with manufacturing conditions should be considered.

INDUSTRIAL APPLICABILITY

As described above, the sliding contact material according to the present invention has high abrasion resistance relative to that of conventional Ag-based sliding contact materials. The present invention is particularly useful as a sliding contact material of a commutator of micromotors for which smaller size and higher rotation number progress. Further, motors such as micromotors produced by use of the sliding contact material according to the present invention are motors with high performance and high durability.

The invention claimed is:

1. A sliding contact material, comprising:

Cu of 6.0% by mass or more and 9.0% by mass or less;

Ni of 0.1% by mass or more and 2.0% by mass or less;

an additive element M of 0.1% by mass or more and 0.8% by mass or less; and the balance being Ag and inevitable impurities, wherein: the additive element M is at least one element selected from the group consisting of Sm, La and Zr;

the sliding contact material has, as a material structure thereof, a material structure in which dispersion particles containing an intermetallic compound containing at least both of Ni and an additive element M are dispersed in an Ag alloy matrix; and a ratio of a Ni content (% by mass) and a content of an additive element M (% by mass) (KNi/KM) in the dispersion particles falls within a range below, when an additive element M is Sm or La: 1.50 or more and 2.50 or less; when an additive element M is Zr: 1.80 or more and 2.80 or less.

2. The sliding contact material according to claim 1, comprising Sm as an additive element M, and having a ratio of Ni concentration ($S_{Ni}$: % by mass) and concentration of an additive element M ($S_M$: % by mass) ($S_{Ni}/S_M$) of 0.80 or more and 5.0 or less.

3. The sliding contact material according to claim 1, comprising La as an additive element M, and having a ratio of Ni concentration ($S_{Ni}$: % by mass) and concentration of an additive element M ($S_M$: % by mass) ($S_{Ni}/S_M$) of 1.50 or more and 5.0 or less.

4. The sliding contact material according to claim 1, comprising Zr as an additive element M, and having a ratio of Ni concentration ($S_{Ni}$: % by mass) and concentration of an additive element M ($S_M$: % by mass) ($S_{Ni}/S_M$) of 1.40 or more and 6.7 or less.

5. The sliding contact material according to claim 1, comprising Zn of 0.1% by mass or more and 2.0% by mass or less.

6. The sliding contact material according to claim 1, comprising Mg of 0.05% by mass or more and 0.3% by mass or less.

7. A method for manufacturing a sliding contact material, the material being defined in claim 1, comprising a step of generating molten metal of an Ag alloy and subsequently cooling and solidifying the molten metal, wherein:

the molten metal of an Ag alloy comprises Cu of 6.0% by mass or more and 9.0% by mass or less, Ni of 0.1% by mass or more and 2.0% by mass or less, an additive element M of 0.1% by mass or more and 0.8% by mass or less, the balance being Ag and inevitable impurities;

temperature of the molten metal of the Ag alloy before the cooling is 1300° C. or higher; and a cooling rate in cooling is set to be 100° C./min or larger, thereby producing the sliding contact material of claim 1.

8. A cladding material formed by combining either Cu or a Cu alloy with the sliding contact material being defined in claim 1.

9. The sliding contact material according to claim 2, comprising La as an additive element M, and having a ratio of Ni concentration ($S_{Ni}$: % by mass) and concentration of an additive element M ($S_M$: % by mass) ($S_{Ni}/S_M$) of 1.50 or more and 5.0 or less.

10. The sliding contact material according to claim 2, comprising Zr as an additive element M, and having a ratio of Ni concentration ($S_{Ni}$: % by mass) and concentration of an additive element M ($S_M$: % by mass) ($S_{Ni}/S_M$) of 1.40 or more and 6.7 or less.

11. The sliding contact material according to claim 3, comprising Zr as an additive element M, and having a ratio of Ni concentration ($S_{Ni}$: % by mass) and concentration of an additive element M ($S_M$: % by mass) ($S_{Ni}/S_M$) of 1.40 or more and 6.7 or less.

12. The sliding contact material according to claim 2, comprising Zn of 0.1% by mass or more and 2.0% by mass or less.

13. The sliding contact material according to claim 3, comprising Zn of 0.1% by mass or more and 2.0% by mass or less.

14. The sliding contact material according to claim 4, comprising Zn of 0.1% by mass or more and 2.0% by mass or less.

15. The sliding contact material according to claim 2, comprising Mg of 0.05% by mass or more and 0.3% by mass or less.

16. The sliding contact material according to claim 3, comprising Mg of 0.05% by mass or more and 0.3% by mass or less.

17. A method for manufacturing a sliding contact material, the material being defined in claim 2, comprising a step of generating molten metal of Ag alloy and subsequently cooling and solidifying the molten metal, wherein:

the molten metal of an Ag alloy comprises Cu of 6.0% by mass or more and 9.0% by mass or less, Ni of 0.1% by mass or more and 2.0% by mass or less, an additive element M of 0.1% by mass or more and 0.8% by mass or less, the balance being Ag and inevitable impurities;

temperature of the molten metal of the Ag alloy before the cooling is 1300° C. or higher; and a cooling rate in cooling is set to be 100° C./min or larger, thereby producing the sliding contact material of claim 2.

18. A method for manufacturing a sliding contact material, the material being defined in claim 3, comprising a step of generating molten metal of an Ag alloy and subsequently cooling and solidifying the molten metal, wherein:

the molten metal of an Ag alloy comprises Cu of 6.0% by mass or more and 9.0% by mass or less, Ni of 0.1% by mass or more and 2.0% by mass or less, an additive element M of 0.1% by mass or more and 0.8% by mass or less, the balance being Ag and inevitable impurities;

temperature of the molten metal of the Ag ahoy before the cooling is 1300° C. or higher; and a cooling rate in cooling is set to be 100° C./min or larger, thereby producing the sliding contact material of claim 3.

19. A cladding material formed by combining either Cu or a Cu alloy with the sliding contact material being defined in claim 2.

20. A cladding material formed by combining either Cu or a Cu alloy with the sliding contact material being defined in claim 3.

* * * * *